United States Patent [19]

Rychlik, deceased et al.

[11] 4,279,573

[45] Jul. 21, 1981

[54] HIGH PRESSURE PUMP

[76] Inventors: Frank J. Rychlik, deceased, late of Chicago, Ill.; by Alan F. Rychlik, executor, 4 Hilltop Crt., Hawthorn Woods, Ill. 60141

[21] Appl. No.: 61,521

[22] Filed: Jul. 27, 1979

[51] Int. Cl.[3] ..... F04B 43/02; F01B 19/02

[52] U.S. Cl. ..... 417/53; 92/101; 417/571; 417/DIG. 1

[58] Field of Search ..... 417/571, DIG. 1, 374, 417/53, 413, 395; 92/98 R, 100, 101; 60/527, 528

[56] References Cited

U.S. PATENT DOCUMENTS

| | | | |
|---|---|---|---|
| 1,363,788 | 12/1920 | Hilton | 417/571 X |
| 2,267,280 | 12/1941 | Kuhnel | 417/480 X |
| 2,354,958 | 8/1944 | Loweke . | |
| 2,843,151 | 7/1958 | Greenwalt . | |
| 2,869,585 | 1/1959 | Baker . | |
| 2,962,974 | 12/1960 | Porkert | 417/571 |
| 2,971,470 | 2/1961 | Wein et al. | 92/101 X |
| 3,019,738 | 2/1962 | Zubaty | 92/101 X |
| 3,442,078 | 5/1969 | Nolan | 60/528 |
| 3,622,251 | 11/1971 | Allen | 417/571 X |

OTHER PUBLICATIONS

*Concise Chemical and Technical Dictionary,* Edited by H. Bennett, Chemical Publishing Co., Inc., 1974, p. 938.

*Encyclopedia of Chemical Technology,* vol. 1, John Wiley & Song, Inc., 1963, pp. 1, 2, 9 and 10.

*Primary Examiner*—Carlton R. Croyle
*Assistant Examiner*—Edward Look
*Attorney, Agent, or Firm*—Wegner, Stellman, McCord, Wood & Dalton

[57] ABSTRACT

A high pressure fluid pump for use such as a fuel injection pump. The pump utilizes a diaphragm for cooperation with valve controlled passage structure leading to the pump chamber to provide the desired high pressure output. The diaphragm is defined by one portion of a diaphragm element, which portion is sealingly bonded peripherally to the wall of the valve body defining the valve chamber. A second portion of the diaphragm element formed unitarily integrally with the diaphragm portion is free to move in the valve chamber and includes a portion extending into a plunger bore for transmitting forces from a reciprocating plunger having an inner end extending into the bore to the diaphragm. The plunger further is provided with a synthetic resin tip. The plunger and tip are arranged to be lubricated during reciprocation of the plunger. A force transfer element extends between the tip and the portion of the diaphragm element extending into the bore and transfers the intermittent pumping force from the plunger tip to the diaphragm element. The diaphragm element may be formed of a flexible material which is self-bonding to the wall of the pump body.

22 Claims, 4 Drawing Figures

FIG. 3
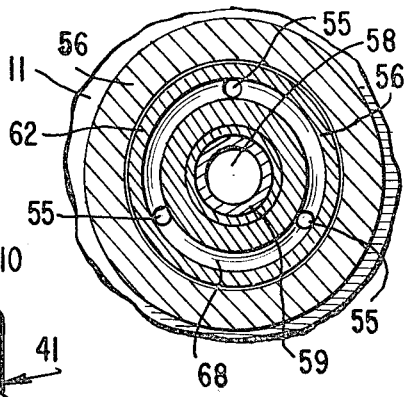
FIG. 1
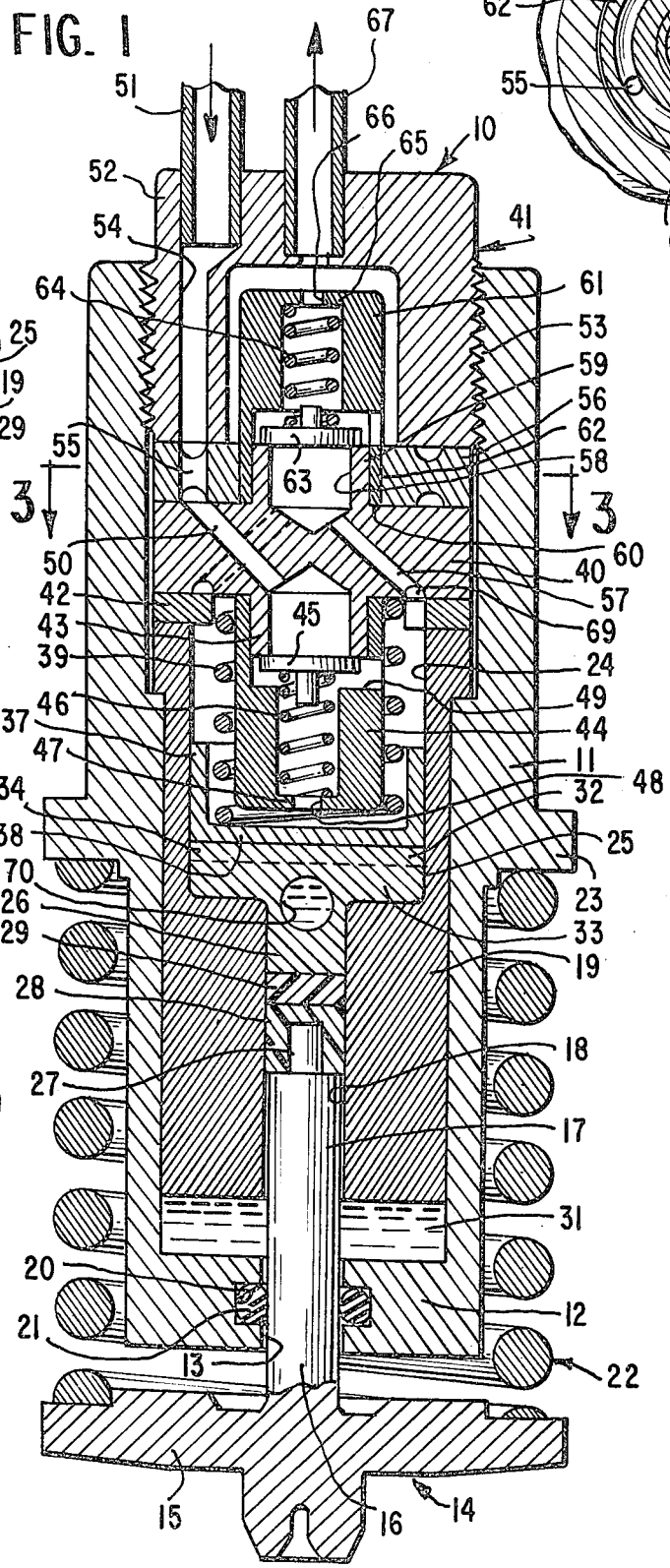
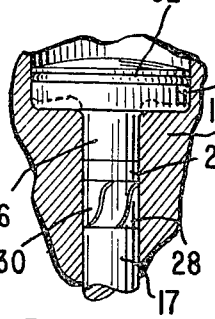
FIG. 2
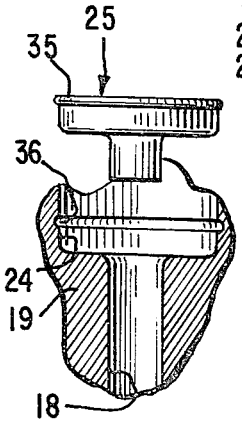
FIG. 4

HIGH PRESSURE PUMP

BACKGROUND OF THE INVENTION

1. Field of the Invention

This invention relates to fluid pumps and in particular to high pressure fluid pumps such as fuel injection pumps for automotive engine application.

2. Description of Background Art

A large number of different pumps has been developed for uses such as providing fuel in automotive and other engine applications. Illustratively, a fuel pump is shown in U.S. Pat. No. 1,984,614 of George R. Welch wherein a piston is utilized to effect the pumping action. The patentee teaches that a certain amount of leakage is sure to occur between the piston and wall of the barrel and provides a channel for returning the fuel to the chamber above the piston.

Claude Sauzedde, in U.S. Pat. No. 1,999,211, shows a compressor utilized in a hydrostatic braking system.

Samuel G. Eskin shows a regulating device in U.S. Pat. No. 2,310,519 wherein a plunger is associated with a body of flexible or resilient material for controlling movement of the plunger. The plunger is moved by extension of liquid in a bulb portion of the device, the movement being controlled by the resilient body.

Cecil W. Smith, in U.S. Pat. No. 2,342,906, shows a pump having a cup-shaped elastic member for protecting the piston so that the pump may be used with abrasive fluids.

A diaphragm pump is shown by Erwin F. Loweke in U.S. Pat. No. 2,354,958 wherein the diaphragm is provided with an annular skirt mounted and bonded to a ring which, in turn, is bolted to the pump cylinder.

In U.S. Pat. No. 2,690,295, Henry J. Rand shows an air pump having a diaphragm including a flat circular disc with integral annular and peripheral flanges extending at approximately right angles from the underface of the disc and a ring-shaped member extending from its upper face. The ring is provided with an eccentrically driven member to reciprocate the diaphragm for alternately expanding and contracting the pumping chamber.

Orro Holm shows, in U.S. Pat. No. 2,712,793, a pump construction utilizing a piston provided with a frustoconical resilient body. By causing a different conicity of the piston and the chamber wall, the resilient body is mechanically sealingly secured therebetween without the need for adhesion means such as vulcanization. In one form, the resilient body includes a disc portion overlying the end of the piston.

Henry A. Berliner, in U.S. Pat. No. 2,791,969, shows a reciprocating pump wherein a hollow cylindrical extensible resilient member is provided within a cylindrical body member and includes a closed end defining with the body member a pump chamber. A rod extends into the resilient member and includes an enlarged end portion bearing against the closed end of the resilient member. The rod is adapted to be reciprocated so as to move the closed end of the resilient member correspondingly to expand and contract the pumping chamber.

In U.S. Pat. No. 2,843,151, Frederick A. Greenawalt shows a hydraulic power element wherein a Teflon plug interconnects a resilient member and an actuating plunger. Pressure acting on the resilient member is transmitted through the plug to the plunger for actuating a control element, such as the control mechanism of the thermostatic device. The fluid pressure is introduced into a second resilient member defining an expansible chamber and abutting the first resilient member.

In U.S. Pat. No. 2,869,585, Max P. Baker shows a flexible diaphragm for use in a pump or the like. The diaphragm has marginal edges thereof shaped to form a seal with portions of the pump when that edge is pressed into sealing engagement by a metallic spring member with the pump body.

A variable rate positive displacement pump is shown in U.S. Pat. No. 2,871,846 of John Zimmerman. The pump is adapted for use as a fuel injection pump and includes a pair of cylinders at opposite sides of a driving eccentric or cam. A plug of resilient material is disposed in a cylinder and engaged by the piston with one end of the plug having a cavity forming a pumping chamber. The reciprocating movement of the piston causes the plug to be periodically compressed so as to vary the volume of the pumping chamber to produce the desired pumping action. The plug engages the walls of the cylinder very tightly to provide a liquid-type seal.

Another pump for use in an injection system is shown in U.S. Pat. No. 2,913,991 of John Dolza et al. This pump is generally similar to that of the Zimmerman pump. In the Dolza et al structure, the resilient plug is maintained under compression at all times so as to maintain a seal thereof with the wall of the cylinder. The rotation of the actuating eccentric causes the plug to expand and contract so as to correspondingly move a plunger so as to vary the capacity of the pumping cavity.

Earl R. Pierce shows, in U.S. Pat. No. 2,929,332, a fuel injection pump wherein a resilient plug is disposed at one end of the cylinder which is compressed so that it will positively engage the end of the piston, the sidewalls of the cylinder, and the end wall of the cylinder. A pumping chamber is formed in an end of the cylinder by a recess in either the cylinder or the resilient plug. Inward movement of the piston compresses the plug and causes the volume of the pumping chamber defined by the recess to decrease and force the liquid therefrom. When the piston moves outwardly, the plug expands and draws a fresh supply of fluid into the chamber.

Lloyd G. Porkert shows a pump unit in U.S. Pat. No. 2,962,974 having a collapsible capsule bonded to a cylinder head and enclosing an expansible chamber of the pump unit.

A variable volume pump is shown in U.S. Pat. No. 3,019,738 of Joseph Zubaty. The pump utilizes a diaphragm actuated by plungers, in turn actuated by a cam mechanism. Each plunger is provided with an individual diaphragm forming one wall of the pump chamber. The side of the diaphragm forming the pump chamber is concave and the head of the pump plunger which contacts and flexes the diaphragm is rounded.

William E. Baker shows a pressure responsive actuator in U.S. Pat. No. 3,078,876 wherein the plunger acts through an actuating member having a conical portion received in a force-transmitting body molded into a recess in the housing. A cup-shaped insert is in bonded relation with the wall of the housing recess. The force-transmitting member is formed of a suitable elastomeric material. The insert may be formed of Teflon. The insert bears against a loosely held metal disc.

Edward A. Cohen et al show a method of constructing an expulsion tank in U.S. Pat. No. 3,471,349 wherein a bladder material is sprayed on an inner surface of a tank segment with a band of bonding material along an inner surface thereof. The cured bladder is separated from the interior surface of the tank segment leaving the edge surface retained by the band of bonding material at the inner surface of the tank segment. Thus, the structure defines a pair of chambers separated by the bladder.

Robert H. Welker shows, in U.S. Pat. No. 3,945,770, a high pressure pump having a resilient plug captured between two nonyieldable members. A dished out portion of the resilient plug is contacted and sealed to define a closed chamber at the dished portion which varies in size as the nonyieldable members are relatively moved.

Abduz Zahid, in U.S. Pat. No. 4,045,861, shows a method of forming a pressure accumulator wherein the mouth of the deformable separator or bladder of the pressure accumulator is molded to one end of the cylindrical portion of the supporting member. The supporting member and bladder are inserted into the open end of a cylindrical casing. The cylindrical portion is fused to the inner surface of the casing.

Thus, the prior art shows a wide range of different fluid control or operating devices wherein deformable members are sealingly secured to an outer housing or body member and suitably moved so as to provide pump or actuating devices.

SUMMARY OF THE INVENTION

The present invention comprehends an improved high pressure fluid pump having a novel diaphragm element for providing an improved long life, troublefree operation.

More specifically, the invention comprehends providing such a fluid pump including a housing, a plunger body in the housing and defining a plunger bore opening into a pump chamber, a reciprocating plunger extending movably into the housing and having inner force-transmitting means slidably received in the plunger bore, a diaphragm element formed of a yieldable material having an outer stem portion slidably received in the bore inwardly of the force-transmitting means and engaged by the force-transmitting means, a transversely enlarged midportion extending inwardly from the stem portion and slidably received in an outer portion of the pump chamber, and an inner portion extending inwardly from the midportion and having a peripheral portion sealingly bonded to the plunger body to define a diaphragm extending across the pump chamber, means for urging the diaphragm outwardly, and valve controlled passage means communicating with the pump chamber inwardly of the diaphragm for conducting fluid into the pump chamber as an incident of outward movement of the diaphragm and pumping the fluid outwardly from the pump chamber as an incident of inward movement of the diaphragm by reciprocating plunger.

Further, the invention comprehends such a fluid pump structure having an improved force-transmitting means. Thus, the plunger defines an inner end. A synthetic resin tip element is mounted on the plunger inner end and is slidably received in the plunger bore. Means are provided for lubricating the plunger inner end and tip element in the bore. A synthetic resin force-transmitting element is slidably received in the plunger bore inwardly of and abutting the tip element. The diaphragm element outer stem portion abuts the force-transmitting element.

The tip element may be provided with a peripheral oil groove for use in the lubrication thereof.

The tip element and the force-transmitting element may be formed of a low friction material, such as tetrafluoroethylene.

The diaphragm element may be formed of a Silastic synthetic resin.

In one form, the diaphragm element is formed of a material which self-bonds to the plunger body.

In one form, the peripheral portion of the diaphragm element inner portion and the plunger body are provided with complementary annular interlock means.

The diaphragm element may be provided internally with a body of substantially incompressible fluid.

The means for urging the diaphragm outwardly may comprise a pressure member forcibly engaging the inner surface of the diaphragm element and means biasing the pressure member outwardly thereagainst.

In the illustrated embodiment, the pressure member comprises a cup member having an outer transverse portion engaging the diaphragm element.

The invention further comprehends a novel method of forming a pump diaphragm in a pump body having a wall portion defining a valve chamber including the steps of providing a release agent on a first portion of the wall portion while leaving an encircling second portion free of the release agent, and providing a body of flexible material in the pump chamber with portions thereof contacting the first and second wall portions, the flexible material comprising a material self-bonding to the first wall portion to effectively define a flexible diaphragm extending across the pump chamber sealingly peripherally bonded to the pump body, the portion of the body abutting the release agent being free to move in the pump chamber.

The flexible material may comprise a synthetic resin material which, in the illustrated embodiment, comprises a Silastic resin.

The method further includes the step of providing a body of oil internally of the flexible material body. The oil may be injected into the body as by conventional hypodermic.

Thus, the invention comprehends an improved fluid pump construction which is extremely simple and economical while yet providing the highly desirable features discussed above. The invention further comprehends a novel improved method of forming the pump diaphragm in association with the pump body.

BRIEF DESCRIPTION OF THE DRAWING

Other features and advantages of the invention will be apparent from the following description taken in connection with the accompanying drawing wherein:

FIG. 1 is a fragmentary diametric section of a fluid pump embodying the invention;

FIG. 2 is a fragmentary enlarged diametric section illustrating in greater detail the inner plunger means and diaphragm element of the pump;

FIG. 3 is a transverse section taken substantially along the line 3—3 of FIG. 2; and FIG. 4 is a fragmentary diametric section illustrating another form of diaphragm element embodying the invention.

DESCRIPTION OF THE PREFERRED EMBODIMENT

In the exemplary embodiment of the invention as disclosed in the drawing, an improved fluid pump generally designated 10 is shown to include a cup-shaped housing 11 having a transverse end wall 12 provided with a through opening 13. A plunger generally designated 14 includes a crown 15 adapted to rock on a conventional cam operated actuator lever such as provided in the conventional internal combustion engines. The plunger includes a stem portion 16 extending through opening 13 and having an inner end 17 slidably received in an axial bore 18 of a plunger body 19 received in the housing 11 in spaced relationship to the end wall 12.

As shown in FIG. 1, end wall 12 may be provided with an annular recess 20 provided with an O-ring 21 for sealing the plunger stem 16 to housing 11.

A helical coil spring 22 is disposed coaxially of the housing and extends between a collar 23 on the housing and the crown 15 to bias the plunger outwardly, as seen in FIG. 1.

At the inner end of bore 18, plunger 19 defines a radially enlarged pump chamber 24. A diaphragm element generally designated 25 is provided in pump chamber 24 and includes an outer portion 26 extending into the inner end of bore 18. As shown in FIG. 1, the distal end 27 of the plunger stem is reduced in diameter. A plunger tip 28 is mounted to said end 27 and comprises a cup-shaped element which is slidably received in the plunger body bore 18 for movement with the plunger stem 16. A force-transmitting element 29 is disposed between plunger tip 27 and the outer portion 26 of diaphragm element 25. As shown in FIG. 2, plunger tip 27 may be provided with one or more oil grooves 30. A body of lubricating oil 31 is sealed in the space between the plunger body 19 and housing end wall 12, as shown in FIG. 1, and serves to lubricate the inner end 17 of plunger stem 16 as well as the tip element 28. Force-transmitting element 29, as shown in the illustrated embodiment, is not provided with the oil grooves.

In the illustrated embodiment, plunger tip 28 is formed of a synthetic resin having low friction and illustratively, may be formed of polytetrafluoroethylene. In the illustrated embodiment, the force-transmitting element 29 is formed of a material having low friction and, illustratively, may also be formed of polytetrafluoroethylene.

Diaphragm element 25 includes an inner portion 32 having a peripheral portion 34 sealingly bonded to the inner surface of the plunger body defining pump chamber 24. The diaphragm element further includes a mid-portion 33 which is disposed outwardly of inner portion 32 but which is not sealingly bonded to the inner surface of the plunger body and, thus, is free to move relative to the surface in the normal operation of the pump. Diaphragm portion 26 similarly is not bonded to the plunger body in bore 18 and, thus, also is free to move therein. Thus, when the plunger 14 is urged inwardly, as illustrated in FIG. 2, force is transmitted from the plunger through the tip 28 and force-transmitting element 29 to the stem portion 26 of the diaphragm element 25 so as to deform the diaphragm element inwardly along the axis thereof. As the peripheral portion 34 of the diaphragm element inner portion 32 is bonded to the plunger body, the inner portion 32 acts as a diaphragm sealed across the pump chamber which is flexed inwardly so as to reduce the volume of the pump chamber inwardly thereof.

Diaphragm element 25 is preferably formed of a flexible and flowable material, such as a Silastic synthetic resin. One method of forming the diaphragm element comprises the steps of introducing the Silastic material into the pump chamber 24 and inner end of bore 18 after applying a thin coating of release agent, such as oil, to the wall surfaces of the pump chamber and bore outwardly of the portion of the pump chamber to which the peripheral portion 34 of the diaphragm element portion 32 is bonded. In this improved manner of forming the diaphragm element, the element is self-bonded to the plunger body to provide a positive sealed diaphragm construction across the pump chamber while yet permitting the ready flexing of the portion of the diaphragm element outwardly of the diaphragm portion 32, as illustrated in FIG. 2.

An alternative method of forming the diaphragm element comprises the preforming of the element and the use of adhesive to bond the peripheral portion 34 to the wall of the pump chamber 24. Still further, as shown in FIG. 4, the diaphragm element may be preformed to define an element 25' having a preformed annular flange 35 adapted to be sealingly secured in a complementary annular groove 26 in the portion of the plunger body defining the portion of the pump chamber 24 bounding the diaphragm portion 32.

As further shown in FIG. 1, a diaphragm cup 37 may be provided in the pump chamber 24 having its bottom portion 38 facially engaging the inner surface of the diaphragm portion 32 so as to effectively contain the flexible and flowable diaphragm element material and thereby cause the amount of displacement of the diaphragm portion 32 to remain constant over the life of the pump. The cup member 37 is slidably received in the pump chamber 24 and is biased outwardly by a coil spring 39 which is compressed between the cup member portion 38 and an outer head member 40 of a valve controlled passage means generally designated 41 mounted in the inner end of the housing 11, as seen in FIG. 1. Head 40 is sealed to the inner end of plunger body 19 by suitable gasket 42.

Head 40 is provided with a tubular, outwardly extending projection 43 to which is mounted a tubular cap 44. A check valve member 45 is biased against the outer end of the projection 43 by a coil spring 46 compressed between the check valve member 45 and an inturned flange 47 on the cup element 44 defining an outer opening 48.

As further shown in FIG. 1, the cap element 44 is provided with a radial passage 49 communicating with the pump chamber 24.

Head 40 is provided with an inlet passage 50 communicating with an inlet fuel supply line 51 connected to a connector member 52 threaded into an internally threaded portion 53 at the inner end of the housing 11. The connector is provided with a through passage 54 which communicates with the inlet passage 50 of head 40 through a transfer passage 55 in an outer head 56.

Head 40 is further provided with an outlet passage 57 communicating between pump chamber 24 and an outlet chamber 58 defined by an outwardly extending tubular extension 59 of the head 40 received within a bore 60 of the outer head 56. An outer cup element 61 includes a sidewall 62 received in the bore 60 between the extension 59 and outer head 56. An outer check valve 63 is provided within the outer cup element 61 and is biased against the extension 59 of head 40 by a suitable coil spring 64 compressed between the check valve 63 and an inturned flange 65 at the outer end of the cup element 61 and defining an axial outlet passage 66. Outlet passage 66 communicates with an outlet line 67 connected to the connector 52, as shown in FIG. 1.

As shown in FIGS. 1 and 3, outer head 56 is provided with a plurality of annular grooves 68 and includes a plurality of passages 55 for facilitated delivery of the fluid fuel from the supply line 51 to the pump chamber 24. Similarly, as shown in FIG. 1, head 40 is provided with an annular groove 69 for facilitating delivery of the high pressure fluid from the pump chamber 24 through the outlet passage 57 to the chamber 58.

As further shown in FIG. 1, diaphragm element 25 may be provided with a body of incompressible liquid, such as oil, 70 in the midportion 33 thereof. Illustratively, the oil 70 may be introduced by means of a hypodermic needle. The oil and material forming the diaphragm element 25 preferably should have an operating range commensurate with the requirements of the engine environment and, illustratively, in the disclosed embodiment, have an operating range of approximately −70° to +500° F. Illustratively, the fluid fuel may be delivered through the supply line 51 at a relatively low inlet pressure of approximately 30 to 40 degrees p.s.i. and delivered from the pump chamber 24 to the outlet line 67 at a relatively high pressure, such as approximately 500 to 5000 p.s.i. Thus, the pump 10 is advantageously adapted for use as a fuel injection pump in an internal combustion engine or the like.

In use, the pump is operated by the reciprocation of plunger 14 which, acting through tip 28 and force-transmitting element 29, flexes the diaphragm element 25 so as to cause suitable variation in the volume of pump chamber 24 which, in cooperation with the valve controlled passage means 41, pumps fluid fuel from inlet 51 to outlet line 67 at the desired high pressure. Lubrication of the tip 28 by means of the oil grooves 30 and lubricating oil 31 provides a long, low maintenance life of the pump. The positive bonding of the diaphragm portion 32 of the diaphragm element 25 to the plunger body 19 and the configuration of the diaphragm element as controlled by the cup member 37 assures an effectively positive constant volume pumping action over the life of the pump.

As disclosed above, pump 10 is extremely simple and economical of construction while yet providing an effectively positive long life troublefree pump means.

The foregoing disclosure of specific embodiments is illustrative of the broad inventive concepts comprehended by the invention.

I claim:

1. A fluid pump comprising:

a housing;

a plunger body in said housing and defining a pump chamber, a plunger bore opening into said pump chamber, and a radially extending planar shoulder therebetween;

a reciprocating plunger extending movably into the housing and having inner force-transmitting means slidably received in said plunger bore;

a diaphragm element formed of a yieldable material having an outer stem portion supportively slidably received in said bore inwardly of said force-transmitting means and engaged by said force-transmitting means, a transversely enlarged midportion extending inwardly from said stem portion and supportively slidably received in an outer portion of said pump chamber, and an inner portion extending inwardly from said midportion and having a peripheral portion sealingly bonded to said plunger body to define a diaphragm extending across said pump chamber;

means for urging said diaphragm outwardly to seat said midportion on said shouder; and valve controlled passage means communicating with said pump chamber inwardly of said diaphragm for conducting fluid into said pump chamber as an incident of outward movement of said diaphragm and pumping the fluid outwardly from said pump chamber as an incident of inward movement of said diaphragm by said reciprocating plunger.

2. The fluid pump of claim 1 wherein said diaphragm element is formed of a Silastic synthetic resin.

3. The fluid pump of claim 1 wherein said diaphragm element is formed of a material which self bonds to the material of said plunger body.

4. The fluid pump of claim 1 wherein said peripheral portion of the diaphragm element inner portion is self-bonded to said plunger body.

5. The fluid pump of claim 1 wherein said peripheral portion of the diaphragm element inner portion and said plunger body are provided with complementary annular interlock means.

6. The fluid pump of claim 1 wherein one of the peripheral portion of the diaphragm element inner portion and confronting portion of the plunger body is provided with an annular groove and the other thereof is provided with an annular rib sealingly secured in said groove.

7. The fluid pump of claim 1 wherein said diaphragm element is provided internally with a body of substantially incompressible fluid.

8. The fluid pump of claim 1 wherein said means for urging the diaphragm outwardly includes a pressure member facially engaging the inner surface of the diaphragm element and means biasing said pressure member outwardly.

9. The fluid pump of claim 1 wherein said diaphragm element is formed of a flowable material and said means for urging the diaphragm outwardly includes a pressure member facially engaging the inner surface of the diaphragm element and means biasing said pressure member outwardly.

10. The fluid pump of claim 1 wherein said diaphragm element is formed of a flowable material and said means for urging the diaphram outwardly includes a cup member having an outer transverse portion facially engaging the inner surface of the diaphragm element and spring means biasing said cup member outwardly.

11. The fluid pump of claim 1 comprising a fuel injection pump, said passage means comprising means for providing fuel fluid to said chamber at a low supply pressure in the range of approximately 30–40 p.s.i.

12. The fluid pump of claim 1 comprising a fuel injection pump, said passage means comprising means for providing fuel fluid to said chamber at a low supply pressure in the range of approximately 30–40 p.s.i., said diaphragm comprising means for pumping the fuel fluid outwardly at a high outlet pressure in the range of at least approximately 500 to 5000 p.s.i.

13. The fluid pump of claim 1 wherein adhesive bonding means are provided for bonding said peripheral portion of the diaphragm element inner portion to said plunger body.

14. A fluid pump comprising:

a housing;

a plunger body in said housing and defining a plunger bore opening into a pump chamber;

a reciprocating plunger extending movably into the housing and having an inner end slidably received in said plunger bore;

a synthetic resin tip element on said plunger inner end slidably received in said plunger bore;

means for lubricating said plunger inner end and tip element in said bore;

a synthetic resin force-transmitting element slidably received in said bore inwardly of and abutting said tip element;

a diaphragm element formed of a yieldable material having an outer stem portion supportively slidably received in said bore inwardly of said force-transmitting element and abutting said force-transmitting element, a transversely enlarged midportion extending inwardly from said stem portion and slidably received in an outer portion of said pump chamber, and an inner portion extending inwardly from said midportion and having a peripheral portion sealingly secured to said plunger body to define a diaphragm extending across said pump chamber;

means for urging said diaphragm outwardly; and valve controlled passage means communicating with said pump chamber inwardly of said diaphragm for conducting fluid into said pump chamber as an incident of outward movement of said diaphragm and pumping the fluid outwardly from said pump chamber as an incident of inward movement of said diaphragm by said reciprocating plunger.

15. The fluid pump of claim 14 wherein said tip element is provided with a peripheral oil groove for use in the lubrication thereof.

16. The fluid pump of claim 14 wherein said tip element is formed of tetrafluoroethylene.

17. The fluid pump of claim 14 wherein said force-transmitting element is formed of tetrafluoroethylene.

18. The method of forming a pump diaphragm in a pump body having a wall portion defining a valve chamber, comprising the steps of:

providing a release agent on a first portion of the wall portion while leaving an encircling second portion free of the release agent; and providing a body of flexible material in said pump chamber with portions thereof contacting said first and second wall portions, said flexible material comprising a material self-bonding to said first wall portion to effectively define a flexible diaphragm extending across the pump chamber sealingly peripherally bonded to the pump body, the portion of the body abutting said release agent being free to move in said pump chamber.

19. The method of forming a pump diaphragm of claim 18 including the step of pouring said flexible material in the form of a flowable synthetic resin material into said pump chamber to provide said body therein.

20. The method of forming a pump diaphragm of claim 18 wherein said flexible material comprises a Silastic resin.

21. The method of forming a pump diaphragm of claim 18 including the further step of providing a body of oil internally of said flexible material body.

22. The method of forming a pump diaphragm of claim 18 including the further step of injecting a body of oil into said flexible material body.

* * * * *